United States Patent [19]

Bartolles

[11] Patent Number: 4,566,368

[45] Date of Patent: Jan. 28, 1986

[54] LEAK DETECTOR FOR SEAL RING OF GUN BREECH MECHANISM

[75] Inventor: Rolf Bartolles, Korschenbroich, Fed. Rep. of Germany

[73] Assignee: Rheinmetall GmbH, Duesseldorf, Fed. Rep. of Germany

[21] Appl. No.: 623,552

[22] Filed: Jun. 22, 1984

[30] Foreign Application Priority Data

Jun. 22, 1983 [DE] Fed. Rep. of Germany ..... 3322437

[51] Int. Cl.[4] ..... F41F 11/00

[52] U.S. Cl. ..... 89/26; 73/167

[58] Field of Search ..... 89/17, 26; 73/167; 346/38; 42/1 A

[56] References Cited

U.S. PATENT DOCUMENTS

| | | | |
|---|---|---|---|
| 167,981 | 9/1875 | Broadwell | 89/26 |
| 2,475,387 | 7/1949 | Golden | 73/167 |
| 3,738,224 | 6/1973 | Post et al. | 89/26 |

*Primary Examiner*—Stephen C. Bentley

[57] ABSTRACT

A gun breech mechanism has a barrel formed with a backwardly open shell chamber, a breech block displaceable into a position rearwardly closing the chamber, and a seal ring between the block and the barrel and having an inner face exposed in the chamber and an outer face lying against the block and barrel. A passage opens at the outer seal-ring face for detecting thereat a gas pressure in excess of a predetermined superatmospheric pressure and a device is provided for generating an alarm signal when such excess pressure is detected. A guide bore formed in the block has an end into which the passage opens and an indicating element having an end exposed at the bore end and slidable in the bore between an inner position with its element end close to the passage and an outer position spaced therefrom. Thus pressurized gas can flow through the passage from the outer seal-ring face to the bore. A spring urges the indicating element inward toward the bore end, that is into the inner position. In addition in the inner position the element is at most flush with a surface of the breech and in the outer position it projects from the surface of the breech.

10 Claims, 4 Drawing Figures

LEAK DETECTOR FOR SEAL RING OF GUN BREECH MECHANISM

FIELD OF THE INVENTION

The present invention relates to a gun breech mechanism of the type used on an artillery cannon. More particularly this invention concerns a device for monitoring the condition of the seal ring of such a mechanism.

BACKGROUND OF THE INVENTION

As described in U.S. Pat. No. 3,420,139 a standard breech mechanism of a cannon has a barrel formed with a backwardly open shell chamber, a breech block displaceable into a position rearwardly closing the chamber, and a seal ring between the block and the barrel and having an inner face exposed in the chamber and an outer face lying against the block and barrel. This seal ring is typically of L-section, having a cylindrical forward flange that fits against the inner surface of the rear end of the barrel and a rear flange that lies against the front face of the breech block.

Obviously this part is subject to considerable heavy-duty stress. It is exposed to extremely high pressures and temperatures with every shot, and can become extremely hot when a volley is being fired. In addition during each reloading operation the breech block slides off its outer face of the rear flange, a spent casing is pulled out through it, a new shell is loaded into the chamber through the ring, and the block slides back into place against the seal.

This seal ring wears out so rapidly that it is made extremely easy to replace in the barrel chamber and the gun crew is normally capable of putting in a new seal in a very short time. A supply of such seals is kept on hand in the field for this purpose.

Even though the above-mentioned patent provides a mechanism that locks out the breech when a sensor detects that there is no ring in the mechanism, as for instance happens occasionally when the casing-ejector hook catches on the ring and pulles it out with the shell, the crew is still exposed to the possibility of there being some leakage through the seal when it merely is damaged slightly or punctured somewhere. In this situation firing gases shoot out between the block and barrel, exposing the crew to these nasty vapors while causing an inevitable loss in muzzle velocity and elevation. This is particularly a problem when operating at night, under actual combat conditions, or when for other reasons the ring cannot be inspected visually each time the gun is reloaded.

OBJECTS OF THE INVENTION

It is therefore an object of the present invention to provide an improved breech mechanism for a large gun.

Another object is the provision of such a breech mechanism for a large gun which overcomes the above-given disadvantages, that is which provides the crew with a sure signal when the seal is leaky.

SUMMARY OF THE INVENTION

A gun breech mechanism has a barrel formed with a backwardly open shell chamber, a breech block displaceable into a position rearwardly closing the chamber, and a seal ring between the block and the barrel and having an inner face exposed in the chamber and an outer face lying against the block and barrel. A passage opens according to this invention at the outer seal-ring face for detecting thereat a gas pressure in excess of a predetermined superatmospheric pressure and a device is provided for generating an alarm signal when such excess pressure is detected.

The system of this invention therefore is based on the discovery that the surest indication of damage to the seal is an overpressure, typically one somewhat above atmospheric pressure, at the outer seal-ring face. Under normal circumstances even a leak that would not be discovered by visual inspection and that is not yet allowing an otherwise perceptible amount of gas through can be detected by the system of this invention. The crew need not bother to make a seal-ring inspection, but can only wait for the signal to be made, at which time a competent crew can switch rings very easily.

The system of this invention has a guide bore formed in the block and having an end into which the passage opens and an indicating element having an end exposed at the bore end and slidable in the bore between an inner position with its element end close to the passage and an outer position spaced therefrom. Thus pressurized gas can flow through the passage from the outer seal-ring face to the bore. A spring urges the indicating element inward toward the bore end, that is into the inner position. In addition in the inner position the element is at most flush with with a surface of the breech and in the outer position it projects from the surface of the breech.

In accordance with another feature of this invention the alarm can be actuated by a switch operable by the element in one of its positions and can incorporate an electrical control device connected to the switch for emitting the alarm signal when the element is in the outer position. This alarm signal can be visual or audible. It can also according to this invention be constituted as a shutdown of the gun, in which the control device includes a cutoff circuit for stopping movement of the breech on the barrel when the signal is emitted. Thus, when leakage through the seal ring is detected, the gun having the breech mechanism is automatically out of service.

According to other features of this invention the ring is formed on its outer surface with an annular groove into which the passage opens. Furthermore the ring is of L-section and has two outer surface portions each formed with a respective such annular groove. This ring is formed with a bleed passage opening only into the two grooves.

DESCRIPTION OF THE DRAWING

The above and other features and advantages will become more readily apparent from the following, reference being made to the accompanying drawing in which.

SPECIFIC DESCRIPTION

Figure 1:
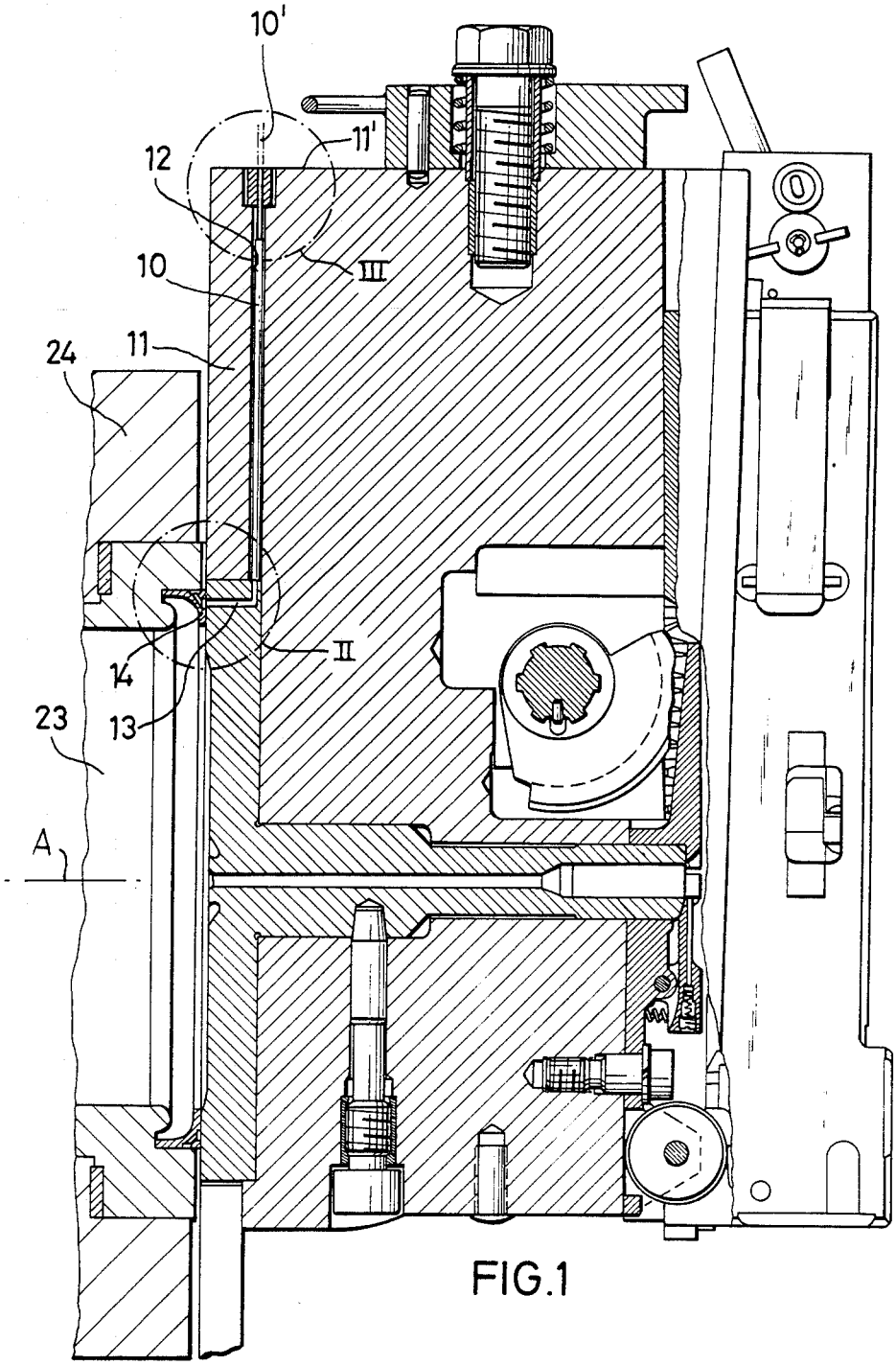
FIG. 1 is a vertical section through a breech of a gun according to this invention.

As seen in FIG. 1 a breech block 11 serves to close the rear end of the bore or chamber 23 of a barrel 24 during firing. The block 11 is of the wedge type that slides transversely of the barrel axis A. This is standard construction and is described in above-cited U.S. Pat. No. 3,420,139 and the references cited therein. To fire a shot the block 11 is slid to the side, normally down, to expose the rear end of the chamber 23 so that a shell can be loaded into it. The block 11 is then slid up to close the rear end of the chamber 23. Firing mechanism inside the breech block 11 detonates the shell so that gases trapped in the chamber 23 behind it propel its projectile with high speed axially forward out the barrel 24. The block 11 is then slid to the side again, an action that typically operates a mechanism that ejects the spent shell casing from the chamber 23 and the cycle can be repeated.

Figure 4:
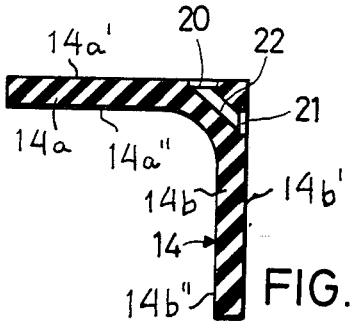
FIG. 4 is a larger-scale section through a part of the breech mechanism according to this invention.

In order to prevent high-pressure gases from escaping from the chamber 23, which loss obviously causes a loss in muzzle velocity and exposes the gun crew to these gases, it is standard to provide an L-section seal ring 14 of approximately the shape shown best in FIG. 4. The ring 14 has a forwardly projecting L-leg or flange **14*a* having cylindrical and coaxial outer and inner surfaces 14*a*' and 14*a*'' and a back flange 14*b* projecting radially inward from the rear end of the flange 14*a* and having planar and parallel outer and inner surfaces 14*b*' and 14*b*'' that are perpendicular to but spaced apart on the axis. Such a seal ring 14 is formed of a rugged elastomer capable of withstanding considerable forces in the chamber 23, since its back surface, between the breech 11 and the barrel 24**, is exposed to no superatmospheric pressure.

Figure 2:
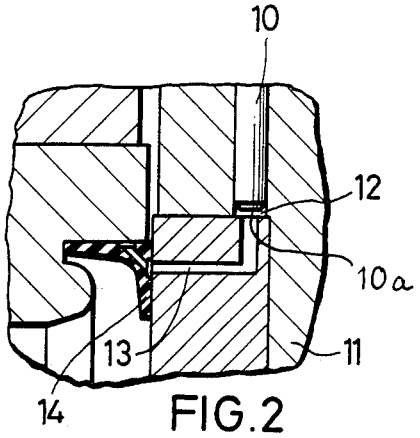
FIG. 2 is a large-scale of the detail indicated at II in FIG. 1.
Figure 3:
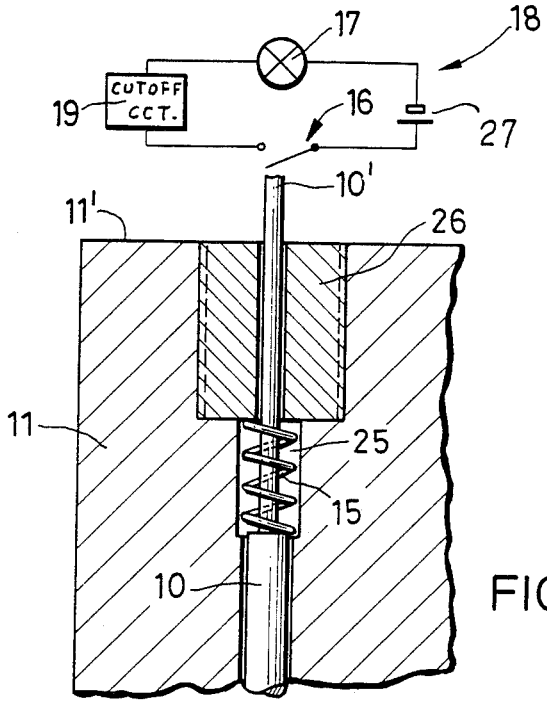
FIG. 3 is a partly schematic large-scale view of the detail indicated at III in FIG. 1.

Damage to this seal 14 is signaled to the gunnery crew according to this invention as best seen in FIGS. 2 and 3 by forming a passage 13 in the block 11 that opens into the radially inner end of a cylindrical guide bore 12 in which a rod 10 is slidable radially of the axis A. This rod 10 has a small-diameter outer-end extension 10' that extends through an outer enlarged part 25 of the bore 12 and through a threaded retaining nut 26. This rod 10 is a tight fit in the bore 12 and is urged radially inward by a compression spring 15 surrounding the inner portion of the extension 10' and braced radially between the retaining nut 26 and the rod 10.

Under normal circumstances there is no leakage through the seal 14 during a shot. The rod 10 is therefore in the inner position shown in solid lines in FIGS. 1 and 2, with the rod extension 10' flush with the top surface 11' of the block 11.

When, however, the seal 14 is damaged and high-pressure gas can leak through it, from its inner faces **14*a*'' and 14*b*'' to its outer faces 14*a*' and 14*b*', this pressure will be effective on the lower end face 1O*a* of the rod 10 and will push it radially outward in the guide 12 to the position shown in dot-dash lines in FIG. 1 and in solid lines in FIG. 3, with the rod extension 10' projecting out past the surface 11' of the breech 11. The spring 15 is fairly weak and the static friction of the rod 10 in the bore 12 is moderate, so that once moved into this outer alarm position the rod 10 will stay in this position. As a result a visible indication is given to the gun crew that the seal 14 has failed. Once the ring 14 is replaced the rod 10** can be manually reset just by pushing it back in with a finger.

In order to ensure that failure anywhere on the ring 14 will be detected, it is formed on its two outer surfaces **14*a*' and 14*b*' with annular grooves 20 and 21 respectively open radially outward and axially backward. Normally the surface 14*a*' lies against a cylindrical surface formed behind a step in the barrel 24 at the rear of the chamber 23 and the surface 14*b*' lies against the planar front face of the breech 11, at a location where the passage 13 opens. In addition the seal 14 is formed with at least one connecting passage 22 opening only into the grooves 20 and 21, so that any pressure in either of these grooves 20 or 21 is transmitted to the other one. As a result a leak that causes an increase in pressure anywhere on the rear faces 14*a*' and 14*b*' will be effective along a path that may include the groove 20, the passage 22, the groove 21, and the passage 13 on the inner face 1O*a* of the piston-like rod 20**.

It is also possible as indicated in FIG. 3 to provide a circuit 18 having a switch 16 that can be closed by the rod end 10' and that is provided in series between the hot side of an electric source 27 and a cutoff circuit 10 and an indicator lamp 17. Thus when the rod end 10' moves out, this switch 16 is closed, thereby cutting off the drive for the breech 11 and giving a visual indication with the lamp 17 of the problem. Of course the alarm lamp 17 could be augmented or replaced by an audible alarm or other suitable such device.

With this system the crew will therefore be warned automatically when the seal ring is leaking. This leakage often precurses graver failure, so the seal ring can be changed before it is a danger. Thus this system not only eliminates the waste of simply replacing the ring very often to avoid failure, but also makes periodic inspections of this seal unnecessary also.

I claim:

1. In a gun breech mechanism having:

a barrel formed with a backwardly open shell chamber, a breech block displaceable into a position rearwardly closing the chamber, and a seal ring between the block and the barrel and having an inner face exposed in the chamber and an outer face lying against the block and barrel, the improvement comprising:

means including a passage opening at the outer seal-ring face for detecting thereat a gas pressure in excess of a predetermined superatmospheric pressure and for generating an alarm signal when such excess pressure is detected.

2. The improved breech mechanism defined in claim 1 wherein the means further includes:

a guide bore formed in the block and having an end into which the passage opens; and an indicating element having an end exposed at the bore end and slidable in the bore between an inner position with its element end close to the passage and an outer position spaced therefrom, whereby pressurized gas can flow through the passage from the outer seal-ring face to the bore.

3. The improved breech mechanism defined in claim 2, further comprising a spring urging the indicating element inward toward the bore end.

4. The improved breech mechanism defined in claim 2 wherein in the inner position the element is at most flush with with a surface of the breech and in the outer position the element projects from the surface of the breech.

5. The improved breech mechanism defined in claim 4 wherein the means further comprises:

a switch operable by the element in one of its positions; and electrical control means connected to the switch for emitting the alarm signal when the element is in the outer position.

6. The improved breech mechanism defined in claim 4 wherein the control means includes cutoff means for stopping movement of the breech on the barrel when the signal is emitted, whereby when leakage through the seal ring is detected the gun having the breech mechanism is automatically out of service.

7. The improved breech mechanism defined in claim 1 wherein the ring is formed on its outer surface with an annular groove into which the passage opens.

8. The improved breech mechanism defined in claim 7 wherein the ring is of L-section and has two outer surface portions each formed with a respective such annular groove, the ring further being formed with a bleed passage opening only into the two grooves.

9. In a gun breech mechanism having:

a barrel formed with a backwardly open shell chamber, a breech block displaceable into a position rearwardly closing the chamber, and a seal ring between the block and the barrel and having an inner face exposed in the chamber and an outer face lying against the block and barrel, the improvement comprising:

a guide bore formed in the block and having an inner end;

a passage extending between the inner bore end and the seal-ring outer face;

an indicating element having an inner end exposed at the bore end and slidable in the bore between an inner position with its inner end close to the passage and an outer position spaced therefrom, whereby pressurized gas can flow through the passage from the outer seal-ring face to the bore and be effective against the inner element end;

means including a spring urging the indicating element into the inner position with a predetermined moderate force smaller than the pneumatic force exerted in the bore on the inner element end when during firing gas from the chamber leaks through the seal to its outer face and thence through the passage to the bore.

10. The improved breech mechanism defined in claim 9, wherein the bore and element are constructed such that the spring force is smaller than the static friction between the element and bore, whereby the spring cannot all alone move the element in the bore.

* * * * *